US006976562B1

(12) United States Patent
Perret, Jr. et al.

(10) Patent No.: US 6,976,562 B1
(45) Date of Patent: Dec. 20, 2005

(54) METHOD OF CALIBRATING A BRAKE SYSTEM FOR STATIONARY EQUIPMENT AND APPARATUS USING THE SAME

(75) Inventors: Joseph Francis Perret, Jr., Silver Spring, MD (US); Michael Barr, Annapolis, MD (US)

(73) Assignee: BTE Technologies, Inc., Hanover, MD (US)

( * ) Notice: Subject to any disclaimer, the term of this patent is extended or adjusted under 35 U.S.C. 154(b) by 0 days.

(21) Appl. No.: 10/650,091

(22) Filed: Aug. 28, 2003

(51) Int. Cl.[7] ..... A63B 21/005
(52) U.S. Cl. ..... 188/24.11; 482/5
(58) Field of Search ..... 188/24.11, 24.19, 188/24.21, 24.22, 158; 303/155; 73/379.01, 73/379.09; 482/1, 4, 5, 51–58, 131, 137

(56) References Cited

U.S. PATENT DOCUMENTS 4,471,957 A 9/1984 Engalitcheff, Jr.
4,475,408 A 10/1984 Browning
4,765,315 A * 8/1988 Krukowski ..... 601/32
4,768,783 A 9/1988 Engalitcheff, Jr.
4,934,694 A * 6/1990 McIntosh ..... 482/9
5,256,115 A * 10/1993 Scholder et al. ..... 482/6
5,711,746 A * 1/1998 Carlson ..... 482/112

OTHER PUBLICATIONS

BTE., *Primus™, The Functional Rehabillrarion System.* Baltimore Therapeutic Equipment Co., Hanover, MD. 4 pages (with Statement of Relevance).
BTE, *Work Simulator®, A Versatile Evaluation and Rehabilitation Instrument*, Baltimore Therapeutic Equipment Co., Hanover MD, 4 pages (with Statement of Relevance).

* cited by examiner

*Primary Examiner*—Chris Schwartz
(74) *Attorney, Agent, or Firm*—Cooley Godward LLP

(57) ABSTRACT

A method of calibrating a brake system includes storing several input-signal-value/output-value associations for a specific brake in a memory unique to the specific brake. The method includes determining an input signal associated with a desired output by interpolating between the stored input-signal-value/output-value associations. In one embodiment, the brake system is used in conjunction with a rehabilitation device to provide a device that accurately produces a desired output.

18 Claims, 5 Drawing Sheets

METHOD OF CALIBRATING A BRAKE SYSTEM FOR STATIONARY EQUIPMENT AND APPARATUS USING THE SAME

BACKGROUND

This invention relates to a calibration system for brake systems, and more particularly to a calibration system for brake systems used in stationary equipment such as medical rehabilitation devices and exercise equipment.

Known rehabilitation devices include a shaft that is coupled to a housing such that the shaft can rotate with respect to the housing. These known rehabilitation devices have a brake or a clutch that is coupled to the shaft. The brake or clutch is configured to apply different outputs, such as a force or a torque resistance, to the shaft to vary the amount of force or torque that is required to rotate the shaft with respect to the housing. In other words, the output applied by the brake or clutch is associated with the amount of torque that is required to be applied by a user to rotate the shaft with respect to the housing. Thus, because the amount of force required to be applied by a user to rotate the shaft with respect to the housing can be varied, a user may use the same rehabilitation device throughout an entire rehabilitation program. Additionally, users who are on different rehabilitation programs may use a common rehabilitation device.

In some of these known rehabilitation devices, an input signal, such as a voltage or a force, is supplied to the brake. The brake output applied to the shaft is based on the input signal that is received by the brake. In some known rehabilitation devices, a one-to-one relationship exists between a value of the input signal supplied to the brake and the value of the output produced by the brake. In other words, each input signal is uniquely associated with a single brake output. Additionally, the brake output is associated with the amount of torque that is required to be applied by a user to rotate the shaft with respect to the housing of the rehabilitation device. Thus, different input signals, such as different amounts of voltage, may be applied to the brake to vary the output produced by the brake, and to, therefore, vary the amount of torque required to rotate the shaft of the rehabilitation device with respect to the housing of the rehabilitation device.

Different brakes may vary slightly in the brake output that is associated with a given input signal. Additionally, individual brakes may change over time such that the brake output that is associated with a given input signal may vary. Thus, some of the known rehabilitation devices include calibrated brakes. A user of a rehabilitation device that includes a calibrated brake may select a desired threshold output value (the amount of torque required to be applied by a user to rotate the shaft of the rehabilitation device with respect to the housing of the rehabilitation device). The rehabilitation device will determine and apply to the brake the input signal necessary to more accurately produce a brake output so that the desired amount of torque rotates the shaft with respect to the housing.

Different known calibration methods have been used to calibrate the brakes of rehabilitation devices.

One method used to calibrate rehabilitation device brakes is an "average" method. The "average" calibration method includes determining, for a series of input signal values, average output values associated with the input signal values for a limited group of the rehabilitation device brakes (the test group). An equation is calculated based on the values of the input signals and the value of the average outputs for the test group. The equation, or a set of equations, is stored in a memory of each rehabilitation device, including rehabilitation devices that have brakes not included in the test group. The equation is subsequently used by the rehabilitation devices to determine the value of an input signal that is required to be applied to the brakes of the rehabilitation devices such that the a desired output is generated. Curve A of FIG. 1 is an example of an input-signal-value/output-value response curve using the "average" calibration method.

The "average" calibration method, however, does not include all of the brakes in the test group. In other words, when determining the average output values for the various input values, not all of the brakes are tested. In addition, any given brake will likely deviate from average, and this deviation may be significant from a performance perspective. All of the brakes, however, are calibrated with the same equation. Thus, the "average" calibration method does not provide for the differences of each brake, and therefore, can be inaccurate when determining the input signal required to be supplied to a specific brake so that the specific brake produces a desired output. Additionally, this method does not compensate for wear and other physical changes of an individual brake over a period of time.

Another calibration method is an "adjusted average" method. Unlike the "average" method each brake is calibrated individually in the "adjusted average" method. Specifically, the "adjusted average" method includes storing an average equation, or set of equations (calculated in the same way that the equation for the "average" method is calculated) in a memory of each brake system. Adjustment factors for each individual brake are then determined and stored in the memory of that individual brake system. The adjustment factors are calculated by supplying each brake with several input signals and determining the difference between the actual output of brake and the "average" output according to the average equation. Thus, the brake system may be programmed to apply the different adjustment factors of the individual brake to the average equation. Curve B of FIG. 1 is an example of an input-signal/output-value response curve using the "adjusted average" calibration method.

For example, for one brake, an adjustment factor of two (2) is applied to the average equation for inputs between a first input signal value and a second input signal value. Similarly, an adjustment factor of negative two (−2) is applied to the average equation for inputs between the second input signal value and a third input signal value. The "adjusted average" method, however, produces discontinuities in the input-signal-value/output-value response curve. Thus, the "adjusted average" method can be inaccurate about these discontinuities when determining the input signal required to be supplied to a brake so that the brake produces a desired output.

Thus, there is a need for a calibration method for a brake system that is specific to the individual brake and that is accurate, so as to not produce discontinuities or other inaccuracies in the input-output response curve.

SUMMARY OF THE INVENTION

A method of calibrating a brake system includes storing several input-signal-value/output-value associations for a specific brake in a memory unique to the specific brake. The method includes determining an input signal value associated with a desired output value by interpolating between the stored input-signal-value/output-value associations. In one embodiment, the brake system is used in conjunction with a rehabilitation device to provide a device that accurately produces a desired output.

DETAILED DESCRIPTION

A method of calibrating a brake system includes storing several input-signal-value/output-value associations for a specific brake in a memory unique to the specific brake. The method includes determining an input signal value associated with a desired output value by interpolating between the stored input-signal-value/output-value associations. In one embodiment, the brake system is used in conjunction with a rehabilitation device to provide a device that accurately produces a desired output.

Figure 1:
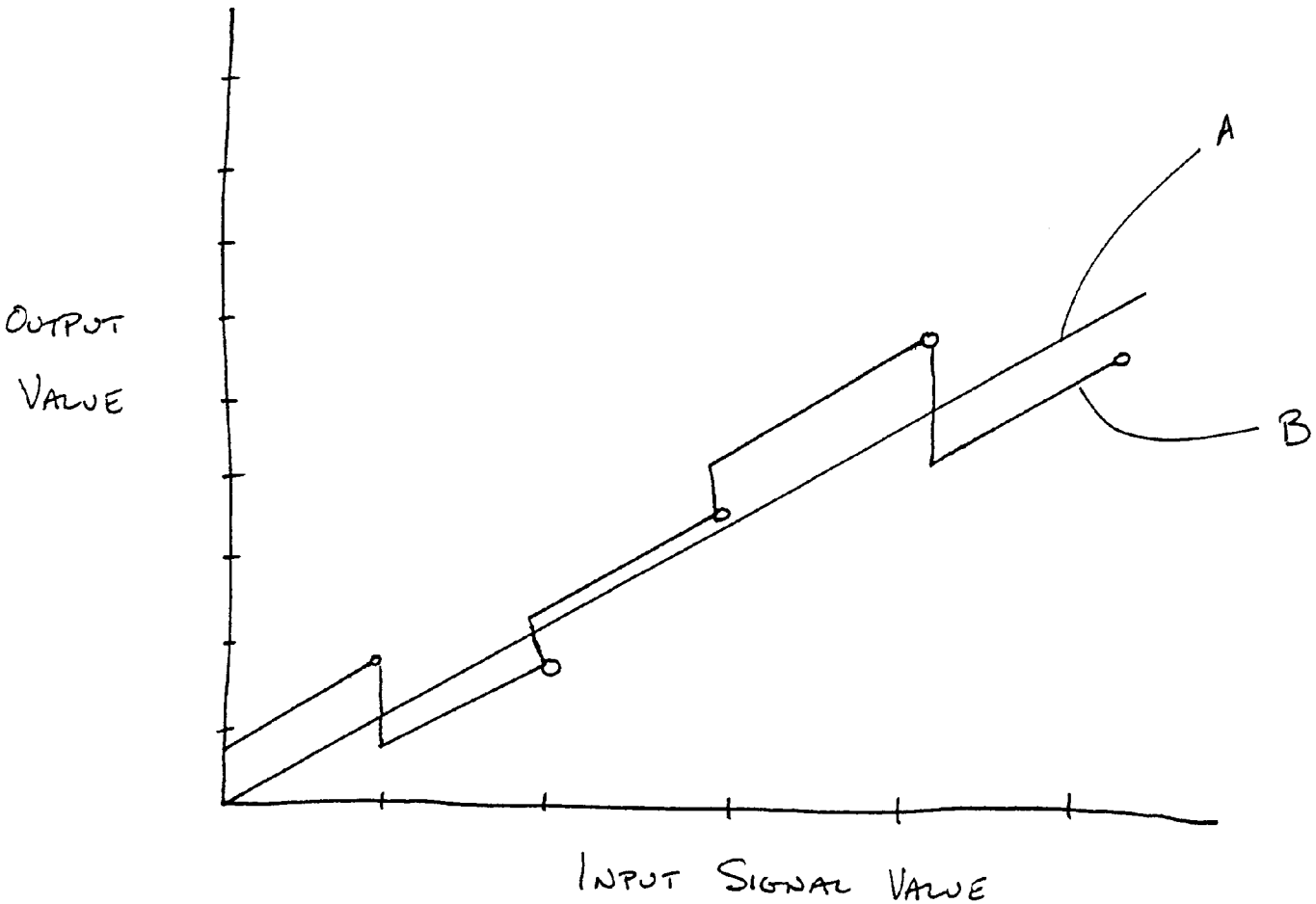
FIGURE 1 (PRIOR ART)
FIG. 1 illustrates several input-signal-value/output-value response curves for brake systems calibrated using known calibration methods.
Figure 2:
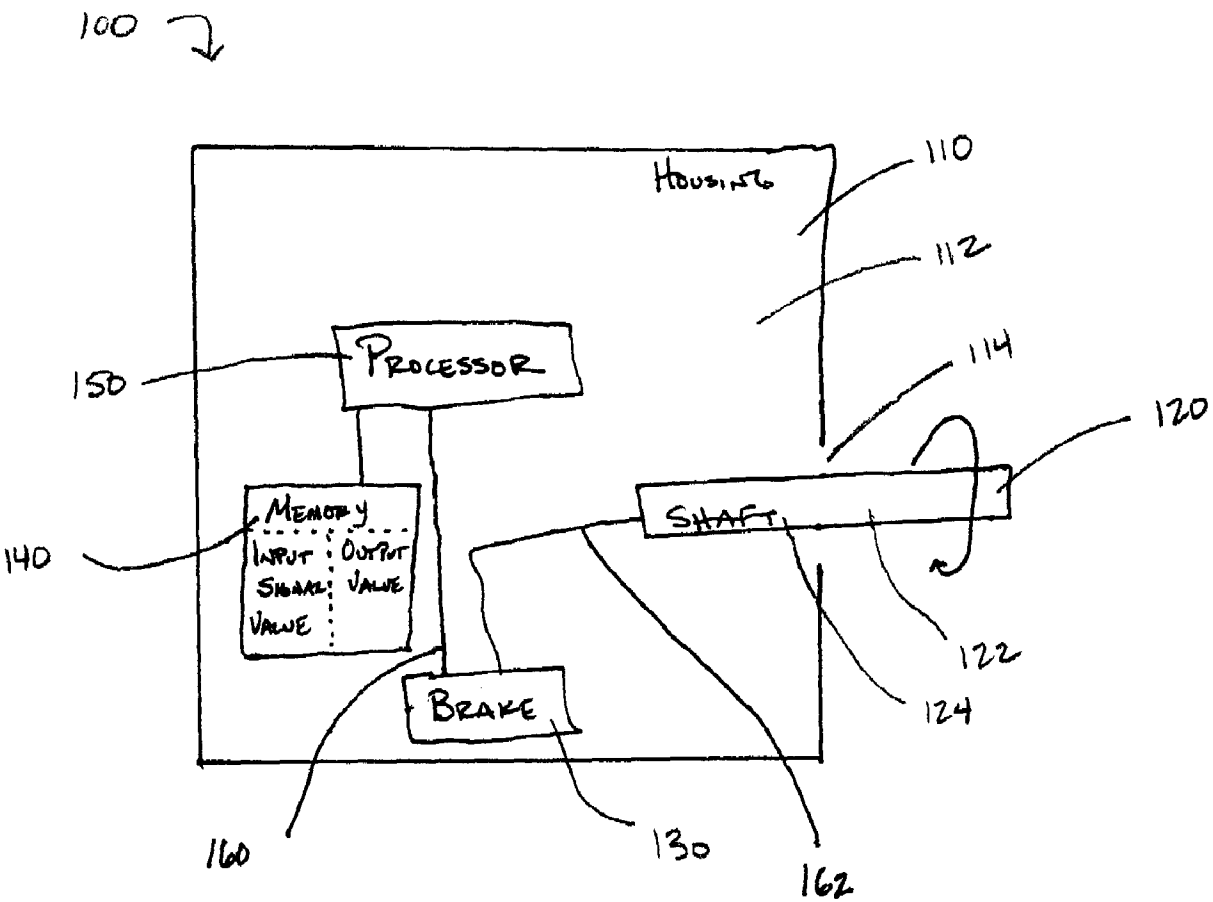
FIG. 2 is a schematic illustration of a brake system according to an embodiment of the invention.

FIG. 2 is a schematic illustration of a brake system 100 that may be calibrated using a calibration method according to an embodiment of the invention. The brake system 100 includes a housing 110, a shaft 120, a brake 130, a memory 140, and a processor 150. The housing 110 includes a cavity 112 and an opening 114 that communicates with the cavity 112. The housing can have a variety of shapes and sizes as appropriate for the application, e.g., a medical rehabilitation device.

In one embodiment, the shaft 120 is coupled to the housing 110 such that the shaft 120 extends through the opening 114 of the housing 110. In other words, a first portion 124 of the shaft 120 is disposed within the cavity 112 of the housing 110, and a second portion 122 of the shaft 120 is disposed outside of the cavity 112 of the housing 110. The shaft 120 is coupled to the housing 110 such that the shaft 120 is configured to move with respect to the housing. For example, in one embodiment, the shaft 120 is rotatably or pivotally coupled to the housing 110 and is configured to rotate with respect to the housing 110. In another embodiment, the shaft is slidably coupled to the housing and is configured to slide or move in a linear motion with respect to the housing.

In one embodiment, the shaft 120 is a cylindrical member. In an alternative embodiment, the shaft is an elongated rectangular member or a member of another shape.

The brake 130 of the brake system 100 is disposed within the cavity 112 of the housing 110 and is coupled to the shaft 120. Although a brake is described and illustrated, it should be understood that a clutch may be used in place of the described brake. Said another way, in an alternative embodiment, the brake system does not include a brake, but rather includes a clutch and the term "brake system" is intended to be broad enough to include a system with a brake or a system with a clutch.

The brake 130 is configured to oppose or resist movement of the shaft 120 with respect to the housing 110. Specifically, the brake 130 is configured to receive an input signal 160 and to apply an associated brake output 162 to the shaft 120. Said another way, the brake 130 produces a first brake output when the brake 130 receives a first input signal. Similarly, the brake 130 produces a second brake output, different than the first brake output, when the brake 130 receives a second input signal, different from the first input signal.

The brake output 162 that is applied to the shaft 120 by the brake 130 is associated with a threshold output. The value of the threshold output is a minimum amount of force that is required to be applied by a user to move the shaft 120 with respect to the housing 110. In other words, when the brake 130 applies the first brake output to the shaft 120, a first threshold output is generated. The value of the first threshold output is the minimum amount of force that is required to be applied to by a user to move the shaft 120 with respect to the housing 110 when the first brake output is applied to the shaft 120. Similarly, when the brake 130 applies the second brake output to the shaft 120, a second threshold output is generated.

The brake 130 may be configured to resist any type of movement of the shaft 120 with respect to the housing 110. For example, in one embodiment, the brake 130 is configured to provide a torque resistance or a rotation resistance to the shaft 120. In such an embodiment, the brake may be configured to grip or grasp the shaft, and thereby provide a frictional resistance to the rotation of the shaft with respect to the housing. In an alternative embodiment, the brake is configured to provide a linear motion resistance to the shaft. In a further alternative embodiment, the brake system includes a clutch that is configured to provide resistance between two independently rotating shafts.

In one embodiment, the brake 130 is an electrical brake. In such an embodiment, the brake 130 is configured to receive an electrical input, such as a voltage. In an alternative embodiment, the brake is a hydraulic brake and is configured to receive a hydraulic input, such as a hydraulic pressure. In a further alternative embodiment, the brake is a pneumatic brake and is configured to receive a pneumatic input, such as a pneumatic pressure. In one embodiment, the brake 130 is configured to receive a digital input. In an alternative embodiment, the brake is configured to receive an analog input.

The memory 140 of the brake system 100 is disposed within the cavity 112 of the housing 110 and is coupled to a processor 150, which will be discussed in more detail below. The memory 140 can be any type of memory device, such as a random access memory or a read-only memory. The memory 140 is configured to store calibration values, input-output associations, or input-signal-value/output-value associations for the brake. In other words, the memory 140 is configured to store several different input signal values and the output values associated with such input values for the brake 130 that is coupled to the memory 140 through a processor 150.

In one embodiment, the memory 140 stores several input signal values and the threshold output values associated with the several input signal values. In other words, the memory 140 stores the amount of force required to be applied by a user to move the shaft 120 with respect to the housing 110 as the threshold output that is associated with a particular input signal value. Thus, in this embodiment, the output value is the value of the threshold output. In an alternative embodiment, the memory stores several input signal values and the brake output value associated with the several input signal values. In other words, the memory stores the output that the brake applies to the shaft as the brake output value associated with a particular input signal value. Thus, in this embodiment, the output value is the value of the brake output 162.

The processor 150 of the brake system 100 is disposed within the cavity 112 of the housing 110 and is coupled to the brake 130 and to the memory 140. The processor 150 can be any type of processor, such as a general purpose processor operating with software or an Application Specific Processor (ASP). The processor 150 is configured to interpolate linearly between the input-signal-value/output-value associations stored in the memory 140 of the brake system 100 to determine an input signal value associated with a desired output value. The term "desired output value" as used herein is intended to be broad enough to include a desired threshold output value and a desired brake output value. In other words, the processor 150 is configured to determine an input signal value associated with a desired output value for the brake 130 by interpolating between a pair of input-signal-value/output-value associations for the brake 130 stored in the memory 140.

The processor 150 is also configured to supply several input signals 160 to the brake 130. The type of input signal 160 that is supplied to the brake 130 is dependant upon the type of brake. For example in one embodiment, the processor is configured to supply different amounts of voltage to an electrical brake. In response to these different amounts of voltage, the brake 130 produces different bake outputs. In another embodiment, the brake is a pneumatic brake and the processor is configured to provide a pneumatic pressure to the brake. In a further alternative embodiment, the brake is a hydraulic brake and the processor is configured to provide a hydraulic pressure to the brake.

Although the brake 130, the memory 140, and the processor 150 have been described and illustrated as being disposed within the cavity 112 of the housing 110, it is not necessary that such components of the brake system 100 be disposed within the cavity 112 of the housing 110. For example in one embodiment, at least one of the brake, the memory, and the processor are disposed outside of the cavity of the housing. In another alternative embodiment, the brake, the memory, and the processor are all disposed outside of the cavity of the housing and for example disposed in a separate housing.

Figure 3:
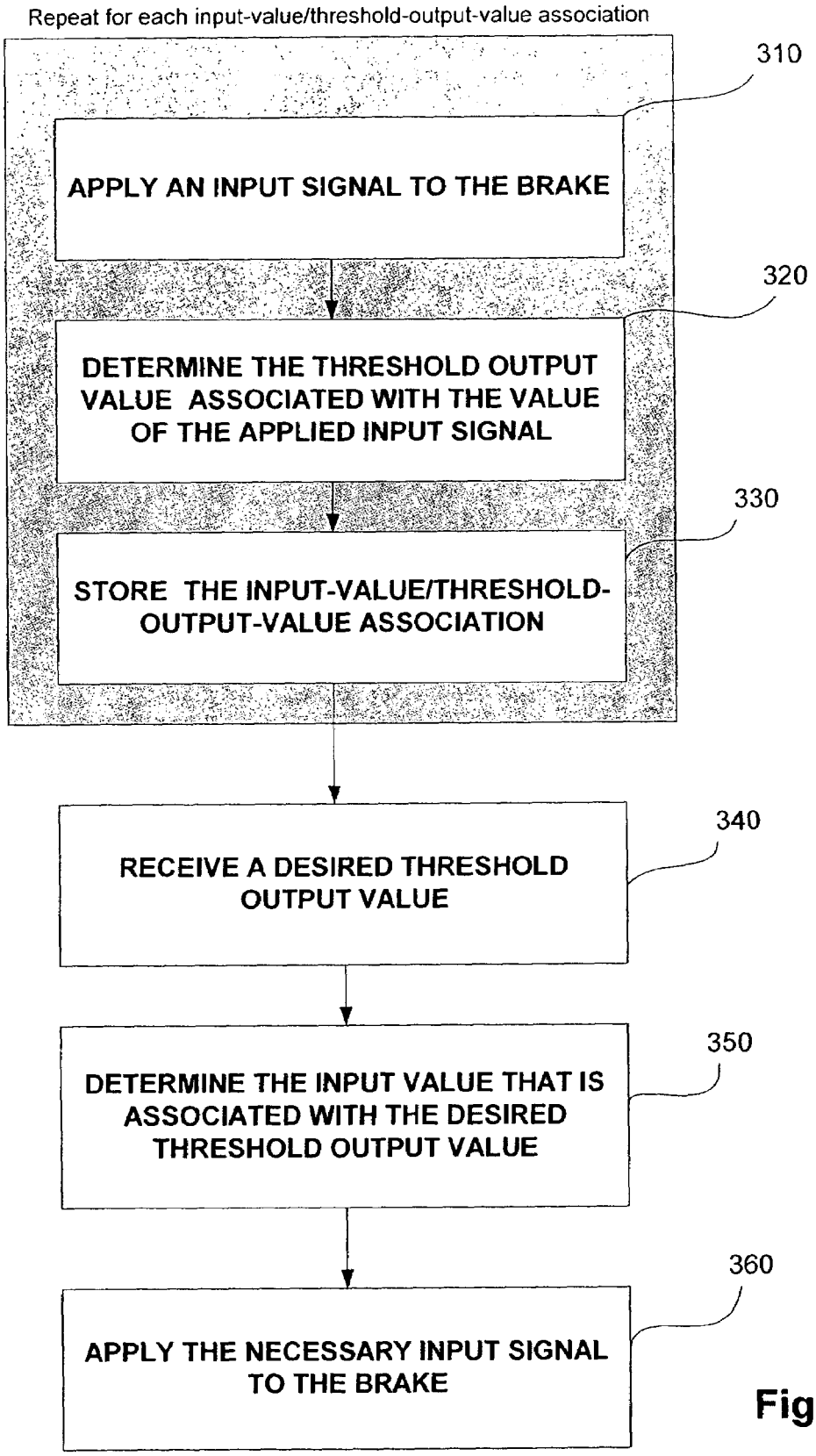
FIG. 3 is a flow chart of a calibration method according to an embodiment of the invention.

As outlined on the flow chart of FIG. 3, a brake of each brake system is calibrated individually. In one embodiment, the calibration of each brake requires several steps, including applying an input signal 160 to the brake, determining the threshold output value associated with the applied input, and storing the input signal value and the associated threshold output value as a input-signal-value/output-value association. Each step is discussed in detail below with respect to the above described brake system 100.

To calibrate the brake 130 of the brake system 100, at step 310, a first input signal is supplied to the brake 130. The first input signal has a value. For example, if the brake is an electric brake, a voltage having a value such as one (1) volt, is supplied to the brake. In response to the input signal 160, the brake 130 applies a brake output 162 or a motion resistance to a shaft 120 of the brake system 100. The brake output 162 or the motion resistance applied to the shaft 120 in response to the received input signal 160 has a value and is associated with a threshold output.

At step 320, the threshold output value that is associated with a brake output 162 is determined by finding the amount of force required to be applied by a user to move the shaft 120 with respect to the housing 110 while the input signal 160 is being supplied to the brake 130. For example, in one embodiment, a strain gauge is coupled to the shaft. In this embodiment, a force is applied by a user to the shaft until the shaft moves or slips with respect to the housing. The strain gauge is configured to determine the amount of force that is required to be applied by a user to the shaft to move the shaft with respect to the housing. This amount of force is the threshold output value that is associated with the input signal 160 when the input signal 160 is applied to the brake. In an alternative embodiment, another force measuring system, such as the torque measuring system disclosed in U.S. Pat. No. 4,475,408, the disclosure of which is herein incorporated by reference, is used to measure the amount of force required to move the shaft with respect to the housing.

At step 330, the input signal value and the threshold output value associated with that supplied input signal value are stored in the memory 140 of the brake system 130 as a calibration value or an input-signal-value/threshold-output-value association.

Steps 310, 320, and 330 are repeated several times for different applied input signals. For example, a first input signal is applied to the brake 130, the associated threshold output (a first threshold output) is determined, and the first-input-signal-value/first-threshold-output-value association is stored in the memory 140. Subsequently, a second input signal, different from the first input signal, is applied to the brake 130, the associated threshold output value (a second threshold output) is determined, and the second-input-signal-value/second-threshold-output-value association is stored in the memory 140.

In one embodiment, steps 310, 320, and 330, are repeated until seven (7) input-signal-value/threshold-output-value associations are stored in the memory 140. In an alternative embodiment, however, the steps are repeated until another number of input-signal-value/threshold-output-value associations, such as two (2), five (5), ten (10), or twenty (20), are stored in the memory.

Figure 4:
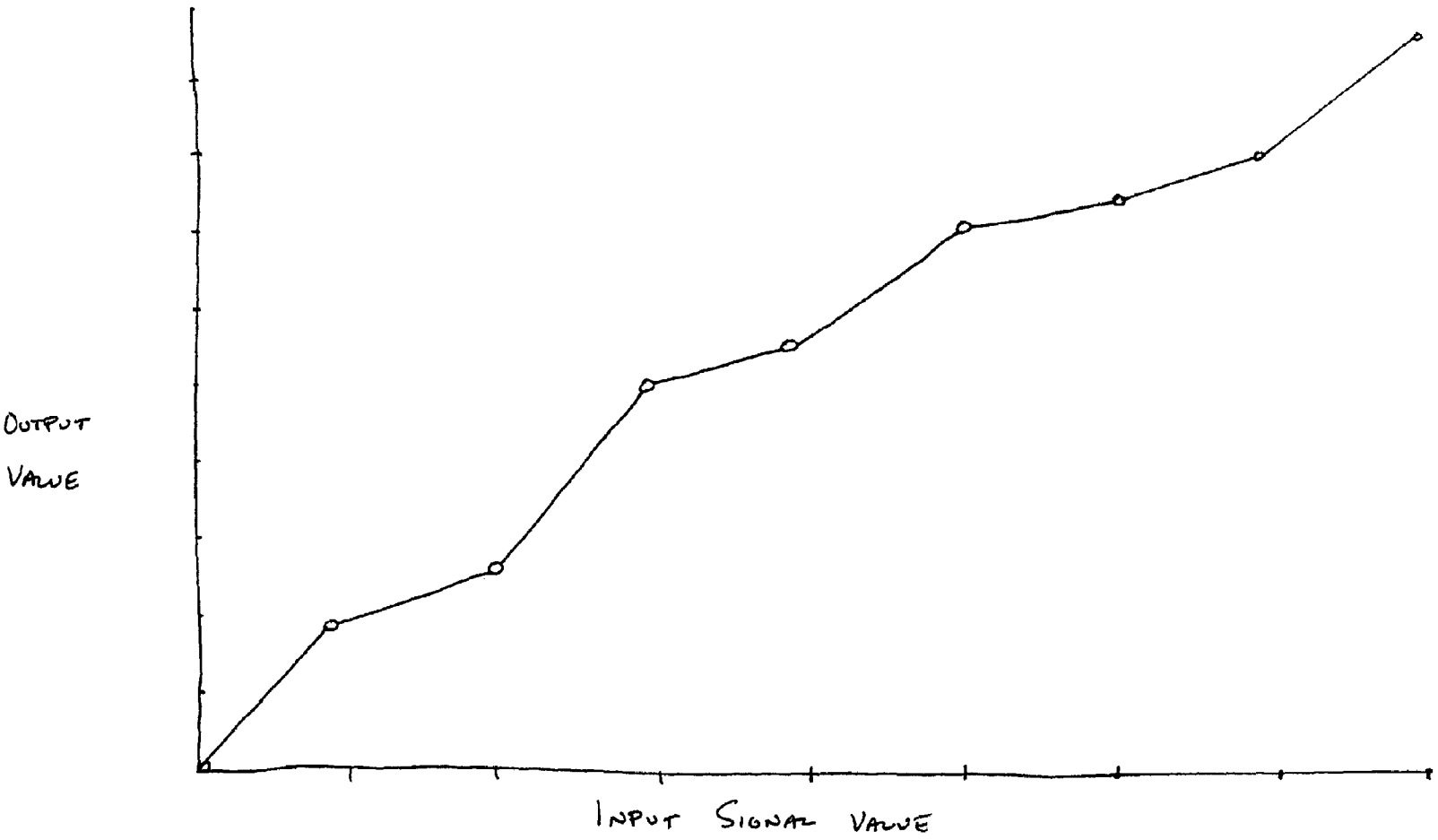
FIG. 4 illustrates an input-signal-value/output-value response curve for a brake system calibrated according to an embodiment of the invention.

In one embodiment, in addition to the seven (7) stored input-signal-value/threshold-output-value associations, an origin association and a theoretical maximum association are stored in the memory 140 of the brake system 100. In other words, an origin-input-signal-value/origin-threshold-output-value association and a theoretical-maximum-input-signal-value/theoretical-maximum-threshold-output-value association are stored in the memory 140 of the brake system 100. In such an embodiment, an input-signal-value/threshold-output-value response curve for the brake 130 is broken by the nine (9) input-signal-value/threshold-output-value associations into eight (8) line segments. The line segments between the input-signal-value/threshold-output-value associations is assumed to be linear. FIG. 4 illustrates an example of such an input-signal-value/threshold-output-value response curve. Although FIG. 4 illustrates input-signal-value/threshold-output-value associations equally spaced from one another, it is not necessary that the stored associations be equally spaced from one another. For example, in one embodiment, the stored associations are closer together near a lower end of the input scale and are spaced further from each other at an upper end of the input scale.

Once several input-signal-value/threshold-output-value associations have been stored in the memory 140 of the brake system 100 at step 340, a desired threshold output value can be received by the brake system 100, for example, the processor 150 of the brake system 100 may receive a desired threshold output value via a selection device. For example, in one embodiment, the desired threshold output value is the amount of force required to be applied by a user to move the shaft 120 of the brake system 100 with respect to the housing 110 of the brake system 100.

At step 350, the processor 150 of the brake system 100 determines the value of the input signal that is associated with the desired threshold output value based on the stored input-signal-value/threshold-output-value associations. In other words, the processor 150 determines the value of the input signal 160 that is to be applied to the brake 130 so that the value of the desired threshold output is required to be applied by a user move the shaft 120 of the brake system 100 with respect to the housing 110 of the brake system 100. Specifically, the processor 150 determines which two (2) of the stored input-signal-value/threshold-output-value associations the value of the desired threshold output is between (a first stored input-signal-value/threshold-output-value association and a second stored input-signal-value/threshold-output-value association), and linearly interpolates between the first stored input-signal-value/threshold-output-value association and the second stored input-signal-value/threshold-output-value association to determine an input signal value that is associated with the value of the desired threshold output. At step 360, the input signal 160 having the value associated with the value of the desired threshold output is then applied to the brake 130 of the brake system 100.

In one embodiment, the processor 150 uses the following equation to linearly interpolate the input signal value that is associated with the value of the desired threshold output.

$x=(y-b)/m$; where x=the input signal value associated with the desired force output;

y=the value of the desired threshold output;

$m=(O_2-O_1)/(I_2-I_1)$; $I_1$ and $O_1$ are the input signal value and threshold output value of the first stored input-signal-value/threshold-output-value association, respectively; $I_2$ and $O_2$ are the input signal value and the threshold output value of the second stored input-signal-value/threshold-output-value association, respectively; and $b=O_1-(m)*(I_1)$.

In alternative embodiments, other methods of linear interpolation are performed by the processor.

Generally speaking, each brake is typically slightly different from other brakes. Thus, to avoid inaccuracies in determining the input signal value associated with a desired threshold output value for an individual brake, brakes are individually calibrated as described above. In other words, to avoid inaccuracies due to the variations of different brakes, the input-signal-value/threshold-output-value associations for an individual brake are stored in a memory uniquely associated with that individual brake. Said another way, if the brake is coupled to a memory, such as coupled via a processor, then that memory is uniquely associated with that brake and the values stored in that memory are used for that brake.

In an alternative embodiment, a brake is calibrated using the brake output values rather than the threshold output values. In other words, the threshold output values associated with different input signal values are not determined, rather the brake output values associated with several input signal values are determined and stored in the memory of the brake system. In this embodiment, a value of a desired brake output is received by the brake system, and the processor of the brake system is configured to determine the input signal value associated with the desired brake output value. In an alternative embodiment, a desired threshold output value is received by the brake system and the processor is configured to determine the desired brake output value associated with the desired threshold output value, such as via a look-up table, and to determine the input signal value associated with the previously determined threshold output value.

In one embodiment, to account for changes in the individual brakes over time, the individual brakes are recalibrated as outlined above periodically, for example every couple of months. In such an embodiment, the input-signal-value/threshold-output-value associations stored in the memory for an individual brake are updated with new input-signal-value/threshold-output-value associations for that individual brake every couple of months. In an alternative embodiment, the individual brakes are recalibrated on a yearly basis.

The calibration method described above may be used with any type of brake system. One example of a brake system that may be calibrated using the method of the invention is disclosed in U.S. Pat. No. 4,471,957, the disclosure of which is herein incorporated by reference.

Figure 5:
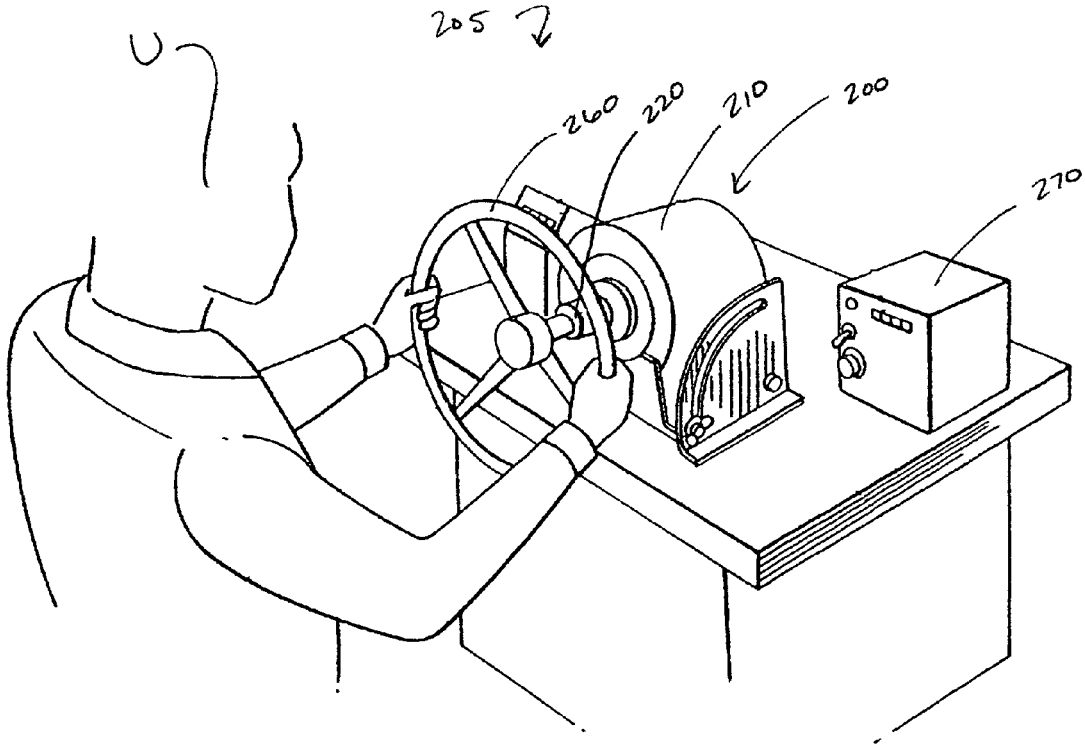
FIG. 5 is a perspective view of a rehabilitation device according to an embodiment of the invention.

Brake systems calibrated using the method described above may be used in connection with many different types of devices. For example, as illustrated in FIG. 5, a brake system 200 calibrated using the method described above may be used in conjunction with a rehabilitation device 205.

The rehabilitation device 205 includes an adapter 260, a selection device 270, and a brake system 200 having a housing 210, a shaft 220, a brake (not illustrated), a memory (not illustrated), and a processor (not illustrated). The shaft 220 extends from the housing 210 and is rotatably coupled to the housing 210. The brake, the memory, and the processor are disposed within the housing 210 and are coupled to the shaft 220. The brake is configured to apply multiple outputs or torque or rotation resistances to the shaft 220.

The adapter 260 is coupled to a portion of the shaft 220 that extends from the housing 210. The adapter can be of any shape. Thus, a user may use different shaped adapters to strengthen different muscles and/or joints of the user or to be used by different users. In one embodiment, the adapter 260 of the rehabilitation device 205 is similar in structure to a steering wheel of a car or a truck. Thus, a user U who has experienced a loss of arm or shoulder strength may use the rehabilitation device 205 to strengthen the arms and/or the shoulders of the user. In an alternative embodiment, the adapter is a key shaped structure.

The selection device 270 of the rehabilitation device 205 is coupled to the brake system 200 and is configured to provide the brake system 200, such as via the processor, with a value of a desired threshold output. In one embodiment, the selection device is a keypad. In an alternative embodiment, the selection device is a keyboard, a dial, a series of buttons, or any other type of input device.

In use, the user U of the rehabilitation device 205 may use the selection device 270 to select a desired threshold output value. In other words, the user U may select an amount of force required to rotate the shaft 220 of the brake system 200 with respect to the housing 210 of the brake system 200. For example, early in the user's rehabilitation program, the desired force output of the brake is a small amount of force. As the strength in the user's arms and/or shoulders increases, the desired force output of the brake is increased.

Similar to the brake system 100 described above, the brake system 200, is configured and calibrated to accurately apply an input to the brake that is associated with the desired force output. Thus, the brake system 200 accurately provides a shaft 220 that requires the user to apply a desired amount of force to rotate the shaft 220 with respect to the housing 210.

A rehabilitation device that includes a brake system that may be calibrated according to the invention is disclosed in U.S. Pat. No. 4,471,957, the disclosure of which is herein incorporated by reference and in U.S. Pat. No. 4,768,783, the disclosure of which is herein incorporated by reference.

Brake systems of other devices such as exercise devices, athletic training devices, and physical therapy devices may be calibrated using the calibration method according to the invention.

While the invention has been described in detail and with references to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. A method of calibrating a brake system for stationary equipment, comprising:

applying a first input signal having a value to a specific brake of the brake system, the specific brake being coupled to a shaft and configured to provide a first brake output to the shaft in response to the first input signal;

determining a value of a first threshold output associated with the value of the first input signal, the value of the first threshold output being the amount of force that moves the shaft with respect to a housing when the first input signal is applied to the brake;

storing in a memory uniquely associated with the brake, an association of the value of the first input signal and the value of the first threshold output;

applying a second input signal having a value to the brake, the brake configured to provide a second brake output to the shaft in response to the second input signal;

determining a value of a second threshold output associated with the value of the second input signal, the second threshold output being the amount of force that moves the shaft with respect to the housing when the second input signal is applied to the brake; and storing in the memory an association with the value of the second input signal and the value of the second threshold output.

2. The method of claim 1, wherein the brake system is disposed within a medical rehabilitation device, the medical rehabilitation device configured to receive input signal values from a therapy user.

3. The method of claim 1, wherein the further comprising:

receiving a desired threshold output, the desired threshold output having a value; and calculating a value of a third input signal needed to be provided to the brake so that the brake provides a third brake output such that the desired threshold output is required to move the shaft with respect to the housing.

4. The method of claim 3, further comprising:

applying a fourth input signal having a value to the brake, the brake configured to provide a fourth brake output to the shaft in response to the fourth input signal;

determining a value of a third threshold output associated with the fourth input signal, the value of the third threshold output being the amount of force that moves the shaft with respect to the housing when the fourth input signal is applied to the brake system;

storing in the memory, an association of the value of the fourth input signal and the value of the third threshold output; and determining whether the value of the desired threshold output is between the value of the first threshold output and the value of the second threshold output or between the value of the second threshold output and the value of the third threshold output.

5. The method of claim 3, wherein the calculating includes interpolating between the association of the value of the first input signal and the value of the first threshold output and the association of the value of the second input signal and the value of the second threshold output.

6. The method of claim 1, wherein the determining the value of the first threshold output includes rotating the shaft with respect to the housing to find a slip point of the brake system.

7. The method of claim 1, wherein the first input signal is a voltage.

8. The method of claim 1, wherein the first input signal is a hydraulic pressure.

9. The method of claim 1, wherein the first input signal is a pneumatic pressure.

10. An apparatus, comprising:

a shaft coupled to a housing and configured to move with respect to the housing;

a specific brake configured to receive a plurality of input signals and to modify a motion of the shaft with respect to the housing in response to the plurality of input signals, each input signal having a value, each input signal from the plurality of input signals being uniquely associated with a brake output, each brake output from the plurality of brake outputs being uniquely associated with a threshold output, a value of each threshold output being an amount of force that moves the shaft with respect to the housing when the associated brake output is produced by the brake;

a memory uniquely associated with the brake and configured to store a plurality of input-signal-value/threshold-output-value associations for the brake; and a processor coupled to the memory and the brake, the processor being configured to interpolate an input signal value based on a threshold output value and the input-signal-value/threshold-output-value associations.

11. The apparatus of claim 10, wherein the brake is disposed with a medical rehabilitation device.

12. The apparatus of claim 10, wherein the brake is an electrical brake and the input signal is a voltage.

13. The apparatus of claim 10, wherein the brake is a hydraulic brake and the input signal is a pressure.

14. The apparatus of claim 10, wherein the brake is a pneumatic brake and the input signal is a pressure.

15. The apparatus of claim 10, wherein the brake is a mechanical brake and the input signal is a force.

16. The apparatus of claim 10, wherein the shaft is configured to rotate with respect to the housing.

17. Processor-readable code stored on a processor-readable medium, the processor-readable code comprising:

code to send a first input signal having a value to a specific brake of a brake system coupled to a shaft and configured to provide an output to the shaft, code to determine a value of a first threshold output based on the first input, the value of the first threshold output being associated with an amount of force that moves the shaft when the first input signal is provided to the brake of the brake system;

code to store an association of the value of the first input signal and the value of the first threshold output;

code to send a second input signal having a value to the brake of the brake system;

code to determine a value of a second threshold output based on the second input signal, the second threshold output being associated with an amount of force that moves the shaft when the second input signal is provided to the brake of the brake system; and code to store an association with the value of the second input signal and the value of the second threshold output.

18. A method of calibrating a brake system, comprising:

applying a first input signal having a value to a specific brake of the brake system, specific the brake being coupled to a shaft and configured to provide a first output to the shaft in response to the first input, the first output having a value;

determining the value of the first brake output;

storing in a memory uniquely associated with the brake, an association of the value of the first input signal and the value of the first output;

applying a second input signal having a value to the brake, the brake configured to provide a second output to the shaft in response to the second input signal, the second output having a value;

determining the value of a second output; and storing in the memory an association with the value of the second input signal and the value of the second output.

* * * * *

UNITED STATES PATENT AND TRADEMARK OFFICE

CERTIFICATE OF CORRECTION

PATENT NO. : 6,976,562 B1 
APPLICATION NO. : 10/650091
DATED : December 20, 2005
INVENTOR(S) : Joseph Francis Perret, Jr. et al.

It is certified that error appears in the above-identified patent and that said Letters Patent is hereby corrected as shown below:

Coversheet, Field (56), References Cited Other Publications
Line 1, replace "Rehabillrarion" with --Rehabilitation--.

Column 11,
Line 15, replace "specific the" with --the specific--.

Signed and Sealed this

Twenty-ninth Day of August, 2006

JON W. DUDAS
*Director of the United States Patent and Trademark Office*